US006454604B1

(12) United States Patent
Currie et al.

(10) Patent No.: US 6,454,604 B1
(45) Date of Patent: Sep. 24, 2002

(54) TWO-LAYER ENCLOSURE FOR ELECTRICAL ASSEMBLIES

(75) Inventors: Gordon Currie, Quezon; Fidel Vista, Las Piñas; Peter Ramos Yeo, Quezon; Cesar Calma, Tandang Sora; Anthony Hernandez, Novaliches, all of (PH)

(73) Assignee: Astec International Limited, Kwun Tong (HK)

( * ) Notice: Subject to any disclaimer, the term of this patent is extended or adjusted under 35 U.S.C. 154(b) by 0 days.

(21) Appl. No.: 09/655,920

(22) Filed: Sep. 6, 2000

(51) Int. Cl.[7] ..... H01R 13/648
(52) U.S. Cl. ..... 439/607
(58) Field of Search ..... 439/188, 676, 439/144, 954, 952, 142, 138; 385/71, 59, 58; 200/51.09; 374/135

(56) References Cited

U.S. PATENT DOCUMENTS 2,735,906 A * 2/1956 Avrunin ..... 439/188
3,755,635 A * 8/1973 McGrill ..... 200/51.09
4,703,989 A * 11/1987 Price et al. ..... 439/188
4,904,879 A * 2/1990 Rudy, Jr. et al. ..... 307/17
5,046,857 A * 9/1991 Metzger et al. ..... 374/135
5,277,602 A * 1/1994 Yi ..... 439/138
5,580,268 A * 12/1996 Miyazawa ..... 439/352
5,605,466 A * 2/1997 Develin et al. ..... 439/144
5,733,145 A * 3/1998 Wood ..... 439/604
5,997,361 A * 12/1999 Driscoll et al. ..... 439/701
6,004,145 A * 12/1999 Gasporpvic et al. ..... 439/76.1
6,056,561 A * 5/2000 Lin ..... 439/121
6,135,816 A * 10/2000 Mashiyama ..... 439/607
6,168,317 B1 * 1/2001 Sahhid ..... 385/71

* cited by examiner

*Primary Examiner*—Brian Sircus
*Assistant Examiner*—J. F. Duverne
(74) *Attorney, Agent, or Firm*—Coudert Brothers LLP

(57) ABSTRACT

An enclosure for small power supplies for cellular telephones, laptop computers and the like is formed in two layers. The first layer is an inner box constructed of a pair of about 0.8 mm thick PBT shells that enclose and retain the electronics. The second layer is an overmolding of about 1.0 mm. thick PVC that surrounds the shells, seals them together, and forms a strain relief for a cable attached to the electronics. The two-layer construction allows considerable savings in material and assembly costs.

2 Claims, 2 Drawing Sheets

TWO-LAYER ENCLOSURE FOR ELECTRICAL ASSEMBLIES

FIELD OF THE INVENTION

This invention relates to a two-layer enclosure for an electrical assembly, and more particularly to a two-layer enclosure construction for power supply units for cell phone battery chargers, laptop adapters, or the like that substantially reduces the cost of mass-producing electrical assemblies of this type.

BACKGROUND OF THE INVENTION

Conventionally, electrical assemblies such as power supply units in phone chargers, laptop computer adapters, or similar low-power applications are enclosed in boxes that are composed of plastic injection parts made from thermoplastic materials such as acrylonitrile butadiene styrene (ABS), polycarbonate (PC), or combinations thereof (PC+ABS). These are expensive materials, and structural considerations require that they be used in minimum thicknesses of 1.6 to 2.0 mm. Following assembly with the electronic components of the apparatus, such boxes are conventionally sealed by electronic welding or by a snap lock and screw.

Aside from the cost of the box itself, the above-described conventional boxes impose constraints 1) on the assembly process for sealing the box, particularly where extra parts such as screws are involved; 2) on the space available for the printed circuit board (PCB); on the method of securing the PCB assembly; and 3) on the size of the box.

In the mass production of small electrical assemblies such as phone chargers, laptop adapters, or other similar units, even a small reduction in size, design cost, or unit production cost can result in huge savings on millions of units. It is therefore highly desirable to provide a power supply box construction which reduces the material cost and facilitates assembly without compromising strength, insulation and safety.

SUMMARY OF THE INVENTION

The present invention overcomes the deficiencies of the prior art by providing a two-layer enclosure in which a two-part inner box injection-molded from 0.8 mm thick flame-retardant polybutylene terephthalate (PBT) houses the electronic components and one or more PCBs of the electrical assembly. The inner box is then assembled by simply overmolding it with a 1.0 mm thick flame-retardant polyvinyl chloride (PVC) layer which strengthens and protects the inner box and enhances its aesthetic appearance. The overmold also allows the customization of the unit for different plug variants, models or equipment manufacturers.

Substantial cost reductions are achieved due to the simplicity of the assembly and the use of thin-walled, low cost materials and cheaper tooling.

DESCRIPTION OF THE PREFERRED EMBODIMENT

Figure 1:
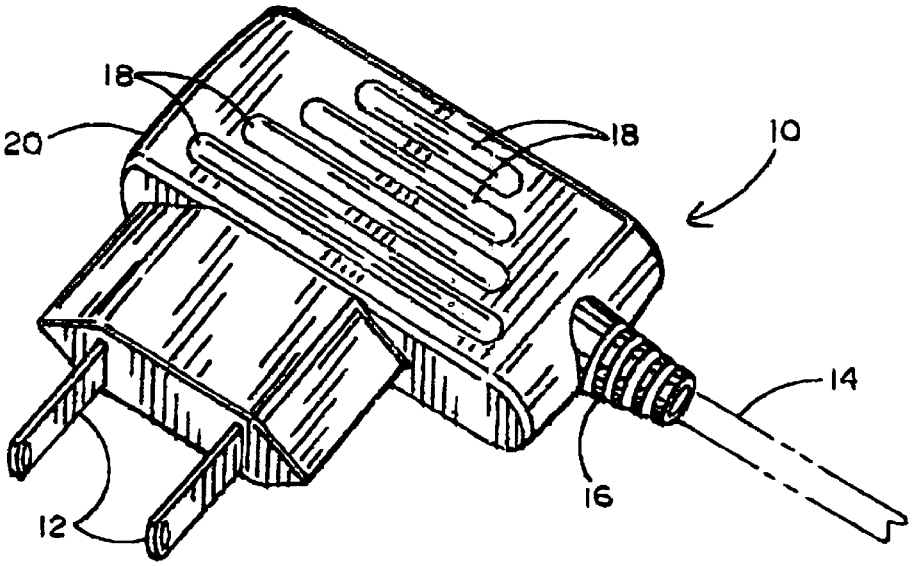
FIG. 1 is a perspective view of a power supply unit constructed in accordance with the invention.

FIG. 1 is an outside view of a power supply unit 10 constructed according to the invention. The unit 10 has a pair of prongs 12 adapted to be plugged into an AC electrical outlet (not shown) and a cable 14 for connection to a cell phone, laptop computer, or other device (not shown). The cable 14 is secured to the unit 10 by a strain relief 16 that is preferably molded onto the cable 14 concurrently with the fabrication of unit 10 as described below. The unit 10 may have grip lines 18 formed therein to facilitate the insertion of unit 10 into, and its removal from, the electrical outlet.

Figure 2:
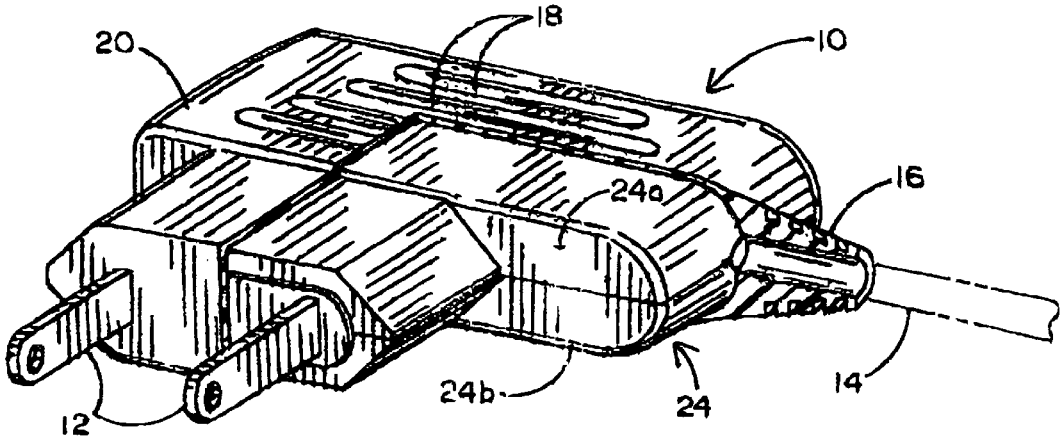
FIG. 2 is a cutaway view of the unit of FIG. 1 showing the two layers of materials used in the invention.
Figure 3:
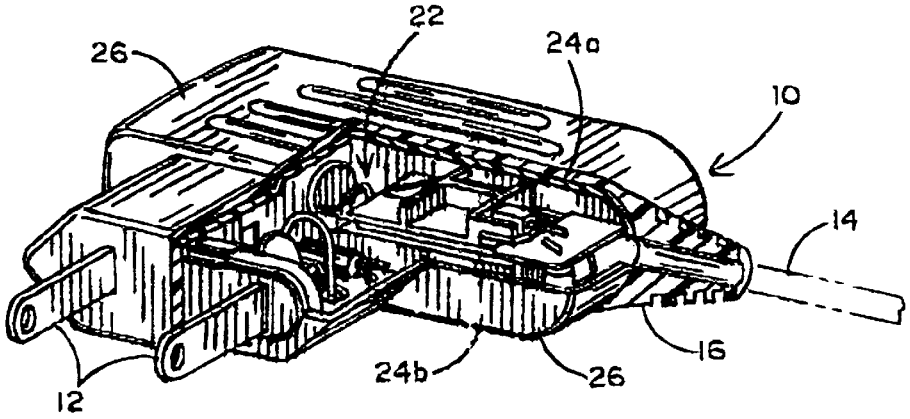
FIG. 3 is a partially cut-away perspective view of the box and electronics.

FIG. 2 illustrates the inventive two-layer construction of the enclosure 20 of the unit 10. In accordance with the invention, the power supply electronics 22 (FIGS. 3 and 4) are enclosed in an inner box 24 composed of an upper shell 24*a* and a lower shell 24*b*. The shells 24*a* and 24*b* are preferably injection-molded from a fire-retardant PBT material such as UV 94 V0 to a thickness of about 0.8 mm. The PBT material in that thickness does not have a great deal of strength (and is therefore not normally used for a thin wall enclosure), but it is a good insulator and is hard enough to effectively support the electronics 22. The shells 24*a* and 24*b* are preferably held together during assembly by conventional mating tabs or other mechanical locking devices (not shown) that align the shells 24*a* and 24*b* with each other.

When the box 24 has been assembled with the cable 14 and the electronics 22, the box 24 and cable 14 are overmolded with an outer layer 26 of fire-retardant PVC material to a thickness of about 1.0 mm. The overmolding 26 gives the box 24 the necessary strength to resist impacts and handling, and also seals it against corrosion by humidity and atmospheric pollutants. The temporary assembly of the box 24 is made permanent by the overmolding 26, and the strain relief 16 is formed as part of the overmolding step.

Figure 4:
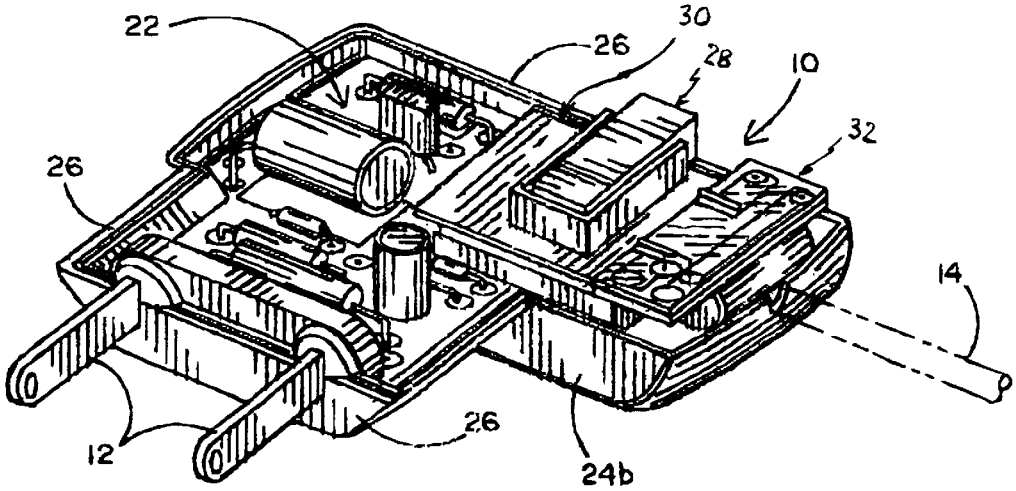
FIG. 4 is a perspective view of the electronics placed into the lower half of the shell.

FIG. 4 illustrates in somewhat stylized fashion a preferred arrangement of the electronics 22 and their mechanical spatial interaction with the box 24. The electronics 22 preferably consist of a transformer 28, a primary PCB 30 connected to the prongs 12, and a secondary PCB 32 connected to the cable 14. The PCBs 30 and 32 are separately soldered to each side of the transformer 28 and carry various capacitors, resistors, inductors and transistors as may be required for the power conversion. The electronics 22 and the pre-molded prongs 12 attached to them are preferably so dimensioned and configured that they will be firmly held in place by the shells 24*a* and 24*b* when the latter are assembled to form the box 24. After the application of overmolding 26, only the prongs 12 and the cable 14 protrude from the unitary, sealed overmolding 26.

PVC and PBT are both considerably cheaper materials than ABS or PC+ABS. For that reason, and because of the reduction in total material volume as compared to the prior art, substantial cost savings are achieved by the two-layer enclosure construction of this invention. It will be understood that the exemplary two-layer enclosure for power supply units described herein and shown in the drawings represents only a presently preferred embodiment of the invention. Indeed, various modifications and additions may be made to such embodiment without departing from the spirit and scope of the invention. Thus, other modifications and additions may be obvious to those skilled in the art and may be implemented to adapt the present invention for use in a variety of different applications.

We claim:

1. An enclosure for an electrical assembly, comprising:

a) a pair of shell elements of a first material adapted to enclose and retain electrical components of said electrical assembly; and b) a covering of a second material overmolded onto said shell elements to sealingly enclose them within said covering, in which said first material is a flame-retardant PBT substantially 0.8 mm thick, and said second material is a flame-retardant polyvinyl chloride substantially 1.0 mm thick.

2. A method of constructing a sealed enclosure for an electrical assembly, including the steps of:

a) supportingly enclosing said electrical assembly in a box formed of shells of a first material; and b) overmolding onto said box a covering of a second material sealingly surrounding said box in which said first material is a flame-retardant PBT substantially 0.8 mm thick, and said second material is a flame-retardant polyvinyl chloride substantially 1.0 mm thick.

* * * * *